US009799182B1

(12) United States Patent
Modi et al.

(10) Patent No.: US 9,799,182 B1
(45) Date of Patent: Oct. 24, 2017

(54) SYSTEMS AND METHODS FOR A SMART DOOR CHIME SYSTEM

(71) Applicant: Google Inc., Mountain View, CA (US)

(72) Inventors: Yash Modi, San Mateo, CA (US); Greg Fulco, San Francisco, CA (US); Andrew Hengel, Los Gatos, CA (US); Kevin Charles Peterson, San Francisco, CA (US); Mark Rajan Malhotra, San Mateo, CA (US); Nina Shih, Mountain View, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 15/141,518

(22) Filed: Apr. 28, 2016

(51) Int. Cl.
*G08B 13/08* (2006.01)
*G08B 13/196* (2006.01)

(52) U.S. Cl.
CPC ..... *G08B 13/08* (2013.01); *G08B 13/19691* (2013.01)

(58) Field of Classification Search
CPC ..... G08B 13/08
USPC ..... 340/545.2
See application file for complete search history.

(56) References Cited

U.S. PATENT DOCUMENTS 4,606,295 A 8/1986 Tang et al.
5,245,694 A 9/1993 Zwern et al.
6,850,601 B2 2/2005 Jones et al.
6,972,677 B2 12/2005 Coulthard et al.
7,405,351 B2 7/2008 Maeng et al.
9,208,676 B2 12/2015 Fadell et al.
2003/0107650 A1 6/2003 Colmenarez et al.
2006/0187034 A1* 8/2006 Styers ..... G05B 9/02 340/545.1
2008/0100705 A1 5/2008 Kister et al.
2010/0225455 A1 9/2010 Claiborne et al.
2010/0245060 A1 9/2010 Tylicki et al.
2012/0169487 A1* 7/2012 Poder ..... B60R 25/102 340/426.15
2012/0293310 A1* 11/2012 Fitzgibbon ..... G08B 3/10 340/328
2013/0187752 A1 7/2013 Grigorian
2014/0240128 A1* 8/2014 Deangelo ..... G08B 13/08 340/545.2
2014/0266669 A1* 9/2014 Fadell ..... G05B 19/042 340/501
2015/0140990 A1* 5/2015 Kim ..... H04W 8/186 455/418
2015/0193127 A1* 7/2015 Chai ..... G06F 3/04842 715/719

(Continued)

*Primary Examiner* — Santiago Garcia
(74) *Attorney, Agent, or Firm* — Morris & Kamlay LLP

(57) ABSTRACT

A system includes a plurality of sensing devices disposed at a premises, the sensing devices being configured to generate data based on activity detected at one or more openings in the premises and to transmit the data, a plurality of speakers dispersed at the premises, a memory configured to store output profiles corresponding to a plurality of respective events and to store a plurality of respective sounds, and a processor configured to identify an event based on the transmitted data and to execute a stored output profile assigned to the event, the execution including automatically playing a stored sound through one or more of the speakers in accordance with the selected output profile.

24 Claims, 5 Drawing Sheets

(56) References Cited

U.S. PATENT DOCUMENTS

| | | | | |
|---|---|---|---|---|
| 2015/0302672 | A1* | 10/2015 | Kalsi | G07C 3/00 340/5.61 |
| 2016/0189496 | A1* | 6/2016 | Modi | G08B 13/08 340/545.2 |
| 2016/0301373 | A1* | 10/2016 | Herman | H03G 3/3005 |
| 2017/0018167 | A1* | 1/2017 | Dey | G08B 25/008 |
| 2017/0039045 | A1* | 2/2017 | Abrahami | G06F 8/41 |

* cited by examiner

| | Event | Output Profile |
|---|---|---|
| 310 | activity: open_door_entry<br>location: front_door<br>actor: unidentified | sound: chime1.mp4<br>rule: all_speakers |
| | activity: open_door_exit<br>location: front_door<br>actor: unidentified | sound: chime2.mp4<br>rule: all_speakers |
| | activity: open_door_entry<br>location: side_door<br>actor: unidentified | sound: bell1.mp4<br>rule: all_speakers |
| | activity: open_door_exit<br>location: side_door<br>actor: unidentified | sound: bell2.mp4<br>rule: all_speakers |
| 320 | activity: open_window<br>location: zone1<br>actor: unidentified | sound: beep1.wav<br>rule: occupied_rooms |
| 330 | activity: open_door_entry<br>location: front_door<br>actor: User_C | sound: song_clip_1.mp4<br>rule: zone1 |

300

FIG. 3

SYSTEMS AND METHODS FOR A SMART DOOR CHIME SYSTEM

BACKGROUND

Homes, offices, and other buildings can be equipped with smart networks to provide automated control of devices, appliances and systems, such as heating, ventilation, and air conditioning ("HVAC") systems, lighting systems, home theaters, entertainment systems, as well as security systems. A monitoring system, such as a security system, can include one or more sensors installed throughout a premises. The sensors can, for example, detect movement or changes in light, sound, or temperature. Homes, offices, and other buildings can also be equipped with door chimes that play a sound through a speaker when a door is opened.

BRIEF SUMMARY

According to an embodiment of the disclosed subject matter, a system includes a plurality of sensing devices disposed at a premises, the sensing devices being configured to generate data based on activity detected at one or more openings in the premises and to transmit the data, a plurality of speakers dispersed at the premises, a memory configured to store output profiles corresponding to a plurality of respective events and to store a plurality of respective sounds, and a processor configured to identify an event based on the transmitted data and to execute a stored output profile assigned to the event, the execution including automatically playing a stored sound through one or more of the speakers in accordance with the selected output profile.

According to another embodiment of the disclosed subject matter, a method of providing a plurality of designated sounds based on detected activities at a premises, includes detecting, with a sensing device, an activity at an opening of the premises, generating data based on the detected activity, transmitting the data to a processor, identifying, with the processor, an event from among a plurality of pre-defined events based on the transmitted data, selecting an output profile from among a plurality of pre-stored output profiles based on the identified event, the selected output profile being assigned to the event, and automatically playing a pre-stored sound through one or more speakers at the premises based on the selected output profile.

According to an embodiment of the disclosed subject matter, means for providing a plurality of designated sounds based on detected activities at a premises includes detecting, with a sensing device, an activity at an opening of the premises, generating data based on the detected activity, transmitting the data to a processor, identifying, with the processor, an event from among a plurality of pre-defined events based on the transmitted data, selecting an output profile from among a plurality of pre-stored output profiles based on the identified event, the selected output profile being assigned to the event, and automatically playing a pre-stored sound through one or more speakers at the premises based on the selected output profile are provided.

Additional features, advantages, and embodiments of the disclosed subject matter can be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than can be necessary for a fundamental understanding of the disclosed subject matter and various ways in which it can be practiced.

FIG. 3 shows a chart with example event-to-output profile assignments according to an embodiment of the disclosed subject matter.

DETAILED DESCRIPTION

Figure 1:
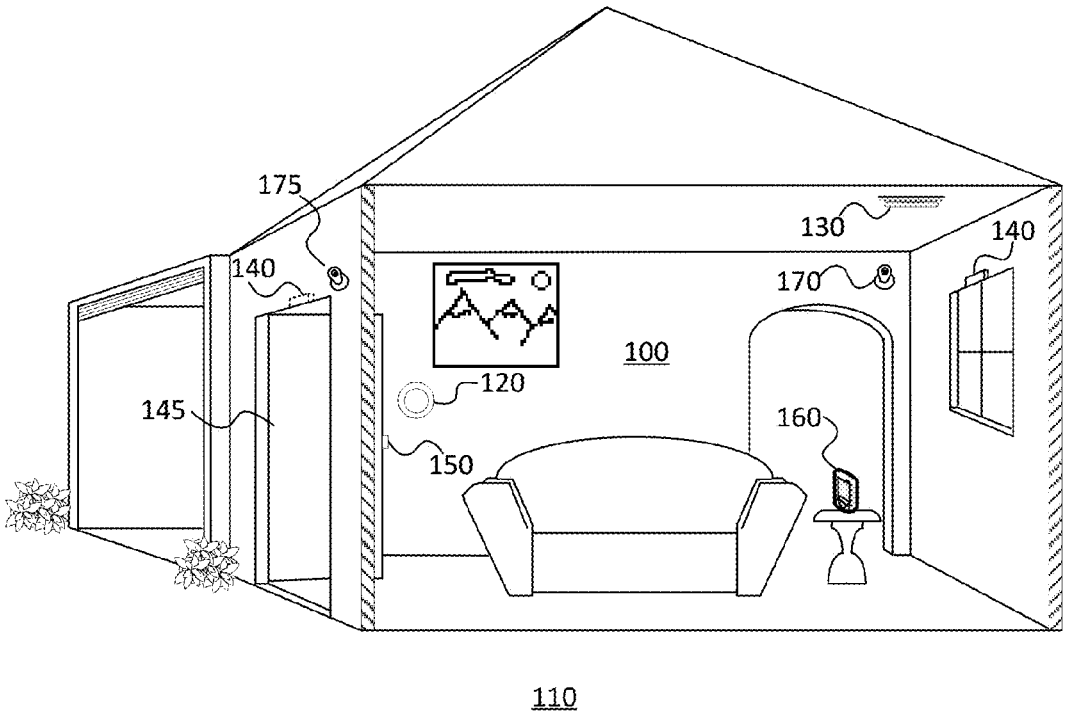
FIG. 1 shows an example premises management system that includes the disclosed smart door chime system according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosed subject matter can be practiced without these specific details, or with other methods, components, materials, etc. In other instances, well-known structures and devices are shown in block diagram form to facilitate describing the subject disclosure.

Some portions of the detailed description are presented in terms of instructions, algorithms and symbolic representations of operations on data bits within a computer memory. These algorithmic descriptions and representations are commonly used by those skilled in the data processing arts to most effectively convey the substance of their work to others skilled in the art. An algorithm is here and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as data, bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "receiving," "determining," "analyzing," "transmitting," "identifying," "sending," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Before providing a detailed discussion of the figures, a brief overview will be given. The disclosed subject matter relates to a smart door chime system that can automatically provide different sounds based on different activities.

Many conventional home security systems utilize a door chime feature to provide audible notice of people coming and going. A common use case is a family with young children desiring to know when the children go outside to play. In this case, a door chime feature announces when a door opens or closes.

At least one problem common to conventional door chime systems is that door chimes offer only one type of sound effect for all doors and windows. As a result, the chime does not provide any information as to exactly which door or window was opened. Furthermore, the homeowner does not know if the chime sound indicates a person leaving the house, coming inside the house, just a window opening, or exactly who opened the door or window.

Another problematic feature common to many conventional door chime systems is disabling a chime from being sounded if one door or window is already open. In the scenario in which the front door is open and then a second door is opened, the opening of the second door does not cause the chime effect to be sounded, thus the residents are not informed.

The disclosed smart door chime system remedies these problems and provides many other improvements. The disclosed system can provide a customized chime or other sound based on current data obtained by sensors, historical data obtained by sensors, user input data, and additional factors as will be described below. The disclosed smart door chime system can process and store data that has been captured by sensors and analyze the data to extract information about the environment, such as activity of a person, identify of a person, activity of a pet, motion, etc. Based on the data, the disclosed smart door chime system selects an output profile that determines a specific sound to be played on a specific set of speakers. Accordingly, many different scenarios may be addressed and customized chimes or sounds can inconspicuously convey to users a wide variety of information about occurrences at a premises.

The disclosed smart door chime system can be implemented as part of a larger system and can be configured to share data with and receive data from other systems installed at the premises or accessible through a network, e.g., the Internet or cloud-based services. For illustrative purposes and to demonstrate examples of coordination with different types of systems, the disclosed smart door chime system will be described below as part of a smart home network environment which will be referred to generically as a "premises management system."

At a high level, a premises management system as described herein can include a plurality of electrical and/or mechanical components. The system can include intelligent, sensing, network-connected devices that communicate with each other and/or can communicate with a central server or a cloud-computing system to provide a variety of security and/or environment management objectives in a premises. Such objectives will collectively be referred to as "premises management." Example objectives may include controlling door chimes, managing alarms, notifying third parties of alarm situations, managing door locks, monitoring the premises, managing temperature, managing lawn sprinklers, controlling lights, controlling media, etc.

A premises management system can include multiple systems/subsystems that collectively manage different aspects of premises management. For example, the disclosed smart door chime system can control a set of functions utilizing one or more speakers in the premises to provide custom sounds upon detected entry/exit. At the same time a smart home subsystem can handle aspects such as automatic light control and lawn watering, while an HVAC subsystem can handle temperature adjustments. Each subsystem can include devices, such as sensors, that obtain information about the environment. This information can be shared across systems.

The individual hardware components of the premises management system that are used to monitor and control the premises in order to carry out premises management objectives will hereinafter be referred to as "premises management devices." Such devices can include multiple physical hardware and firmware configurations, along with circuitry hardware (e.g., processors, memory, etc.), firmware, and software programming that are capable of carrying out specific objectives and functions of the premises management system. Collectively, premises management devices can be controlled by a "brain" component, as will be described further below. The brain component can be implemented in a controller device or in one or more of the premises management devices.

Turning now to a more detailed discussion in conjunction with the attached figures, FIG. 1 shows an example premises management system 100 that includes the disclosed smart door chime system. The system 100 can be installed within a premises 110, for example, a house and garage. The system can also include multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles (or door locks) 150, one or more intelligent, multi-sensing, network-connected controller devices 160, and one or more intelligent, multi-sensing, network-connected camera devices 170. Data captured by any of these or other devices can be used by the disclosed smart door chime system.

Each of the thermostat 120, hazard detection unit 130, entry detection unit 140, door handle 150, controller device 160, and camera 170 can include different types of sensors, e.g., image sensors, infrared sensors, motion sensors, contact sensors, microphones, thermal sensors, etc. Collectively, these devices 120-170 will be referred to as sensing devices, or sensors. A single room and garage is illustrated for simplicity, however, sensing devices can be installed throughout the premises 110 in multiple rooms, at various openings, doors and windows throughout the premises 110, and at peripheral locations outside of the premises 110, such as at a garage or gate.

In an example scenario of operations for the disclosed smart door chime system, when the front door 145 opens the entry detection unit 140 detects the movement and generates data. Herein, an action that is detected by a sensing device will be referred to generally as an "activity." The entry detection unit 140 (or other sensing device) transmits data that indicates the type of activity that was detected, e.g., "door opened," or "motion detected." The data transmission is received by a processor, which may be implemented, for example, in the thermostat unit 120 or in the controller device 160.

The transmitted data can include an indication of where the activity was detected. For example, the data can include a device identifier that indicates which device detected the activity, or it can include additional data that identifies a particular room, zone or area of the premises wherein the sensing device is disposed. When the processor receives the data, the processor automatically determines whether a registered event has occurred and executes a corresponding output profile.

Herein, an "event" is a data entity that includes an activity, a location, and an optionally an actor. Identifiable activities depend upon on the configuration/components of the given system and can range from relatively simple detection of movement to more complex inference of direction and intent, e.g., detecting that an known individual has approached a door from the outside, opened the door, and entered the premises. Furthermore, due to the location aspect of an "event," in a premises that includes multiple doors an activity "door opened" can occur at different locations, such as a front door, back door, or side door, and each would correspond to a different identifiable event.

An "output profile" refers to a data entity that includes data that indicates one or more associated stored sounds and a rule that determines how the sound(s) will be outputted. As will be described further below, various devices may function as a memory storage device for the disclosed smart door chime system. The memory stores output profiles, event-to-profile assignments, and two or more different types of chimes, or sounds.

A "registered event" refers to a predefined event that has been stored in the system memory and assigned an output profile.

Figure 2:
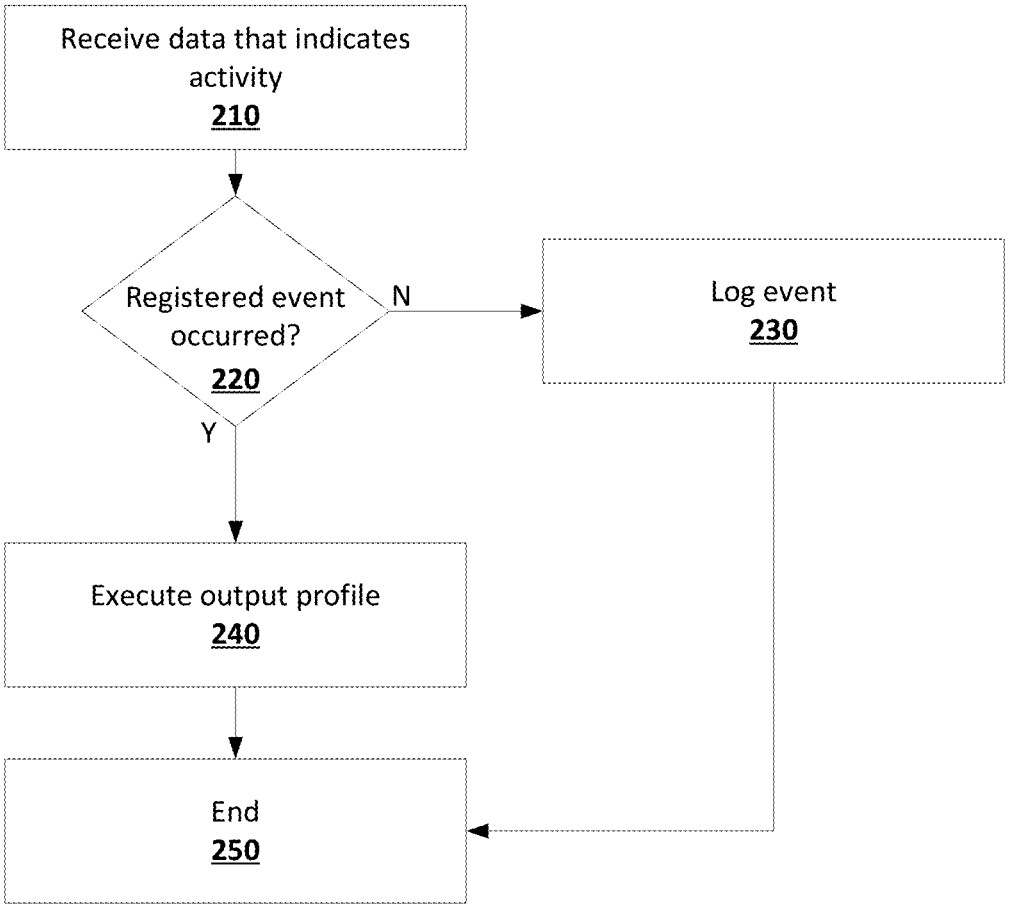
FIG. 2 shows a shows a flowchart of operations for a smart door chime system according to an embodiment of the disclosed subject matter.

FIG. 2 shows a flowchart 200 of operations for an embodiment of the disclosed smart door chime system. At operation 210, the processor receives the data transmitted from a sensing device, e.g., the entry detection unit 140. At operation 220 the processor determines whether a registered event has occurred. If the data does not indicate that a registered event has occurred, then the processor can log the event in operation 230. As will be described further below, the log can serve as the basis for the system recommending new events to the user. If the data does indicate that a registered event has occurred, then at operation 240 the processor retrieves and executes the corresponding output profile. The process ends at operation 250.

FIG. 3 shows a chart 300 with example event-to-output profile assignments. Based on a first assignment 310, when an unidentified individual enters through the front door (event), the smart door chime system plays a sound, chime1.mp4, through all available speakers, in accordance with the rule designated in the assigned output profile.

As indicated above, the capabilities of the disclosed smart door chime system depend on the components (e.g., different types of sensing devices) that are available. Referring to FIG. 1, the premises management system 100 that operates the disclosed smart door chime system can operate as a learning, evolving ecosystem of interconnected devices. At a hardware level new premises management devices can be added, for example, to introduce new functionality, expand existing functionality, or expand a spatial range of coverage of the system. Each device can operate under a basic protocol such that existing premises management devices can be replaced or removed without causing a failure of the system 100. Such removal can encompass intentional or unintentional removal of components from the system 100 by an authorized user, as well as removal by malfunction (e.g., loss of power, destruction by intruder, etc.).

Due to the dynamic nature of the system 100, the overall capability, functionality and objectives of the system 100 can change as the constitution and configuration of the system 100 change. The types of data that can be used by the disclosed smart door chime system can also correspondingly change. For example, data that provides an indication of environmental sound can be available in one configuration while data that provides an indication of environmental temperature can be available in another configuration.

In order to avoid contention and race conditions among interconnected devices, the disclosed smart door chime system and the handling of certain system level decisions can be centralized in a "brain" component. The brain component can coordinate decision making across subsystems, the entire system 100, or a designated portion thereof. The brain component is a system element at which, for example, sensor/detector states converge, user interaction is interpreted, sensor data is received, subsystems are coordinated, and decisions are made concerning the state, mode, or actions of the system 100. Hereinafter, the system 100 brain component will be referred to as the "primary system processor." The primary system processor can be implemented, for example, in the controller device 160, via software executed or hard coded in a single device, or in a "virtual" configuration, distributed among one or more external servers or one or more premises management devices within the system. The virtual configuration can use computational load sharing, time division, shared storage, and other techniques to handle the primary system processor functions.

The primary system processor can be configured to implement the disclosed smart door chime system and to execute software to control and/or interact with the other subsystems and components of the premises management system 100. Furthermore, the primary system processor can be communicatively connected to control, receive data from, and transmit data to premises management devices within the system 100 as well as to receive data from and transmit data to devices/systems external to the system 100, such as third party servers, cloud servers, mobile devices, and the like.

Premises management devices (e.g., 120-150, 170) can include one or more sensors. In general, a "sensor" can refer to any device that can obtain data that provides an indication of a state or condition of its local environment, e.g., sound, light, temperature, etc. Such data can be stored or accessed by other devices and/or systems/subsystems. Sensor data can serve as the basis for information determined about the sensor's environment and as the basis for operation of the smart door chime system.

Any premises management device that can capture data from the environment can be used as a data source for the disclosed smart door chime system. A brief description of sensors that can function as data sources that can be included in the system 100 follows.

The examples provided below are not intended to be limiting but are merely provided as illustrative subjects to help facilitate describing the subject matter of the present disclosure. It would be impractical and inefficient to list and describe every type of possible sensor data source. It should be understood that deployment of types of sensors that are not specifically described herein will be within the capability of one with ordinary skill in the art.

Sensors can be described by the type of information they collect. In this nomenclature sensor types can include, for example, motion, smoke, carbon monoxide, proximity, temperature, time, physical orientation, position, acceleration, location, entry, exit, presence, pressure, light, sound, and the like. A sensor can also be described in terms of the particular physical device that obtains the environmental data. For example, an accelerometer can obtain acceleration data, and thus can be used as a general motion sensor and/or an acceleration sensor. A sensor can also be described in terms of the specific hardware components used to implement the sensor. For example, a temperature sensor can include a thermistor, thermocouple, resistance temperature detector, integrated circuit temperature detector, or combination thereof.

A sensor further can be described in terms of a function or functions the sensor performs within the system 100. For example, a sensor can be described as a security sensor when it is used to determine security events, such as entry or exit through a door.

A sensor can serve different functions at the same time or at different times. For example, system 100 can use data from a motion sensor to determine the occurrence of an activity in a given area of the premises 110, e.g., "front door opened," or to determine how to control lighting in a room when an individual is present, or use the data as a factor to change a mode of a security system on the basis of unexpected movement when no authorized party is detected to be present.

In some cases, a sensor can operate to gather data that indicates multiple types of information sequentially or concurrently. For example, a temperature sensor can be used to detect a change in atmospheric temperature as well as to detect the presence of a person or animal. A sensor can also operate in different modes (e.g., different sensitivity or threshold settings) at the same or different times. For example, a sensor can be configured to operate in one mode during daytime and another mode at night.

Multiple sensors can be arranged in a single physical housing, such as where a single device includes movement, temperature, magnetic, and/or other sensors. Such a housing can generally be referred to as a "sensor" or premises management device.

Figure 4:
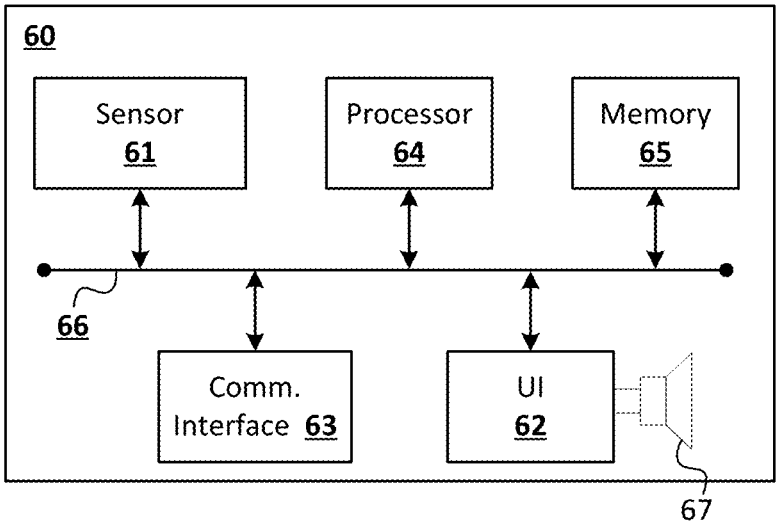
FIG. 4 shows an example premises management device according to an embodiment of the disclosed subject matter.

FIG. 4 shows an example premises management device 60 including a processor 64, a memory 65, a user interface 62, a communications interface 63, an internal bus 66, and a sensor 61. A person of ordinary skill in the art would appreciate that components of the premises management device 60 described herein can include electrical circuit(s) that are not illustrated, including components and circuitry elements of sufficient function in order to implement the device as required by embodiments of the subject disclosure. Furthermore, it can be appreciated that many of the various components listed above can be implemented on one or more integrated circuit (IC) chips. For example, a set of components can be implemented in a single IC chip, or one or more components can be fabricated or implemented on separate IC chips.

The sensor 61 can be equipped to function as an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, imager, camera, compass or any other type of sensor that captures data or provides a type of information about the environment in which the premises management device 60 is located.

The processor 64 can be a central processing unit (CPU) or other type of processor chip, or circuit. The processor 64 can be communicably connected to the other components of the premises management device 60, for example, to receive, transmit and analyze data captured by the sensor 61, transmit messages, packets, or instructions that control operation of other components of the premises management device 60 and/or external devices, and process communication transmissions between the premises management device 60 and other devices. The processor 64 can execute instructions and/or computer executable components stored on the memory 65. Such computer executable components can include, for example, a primary function component to control a primary function of the premises management device 60 related to managing a premises, a communication component configured to locate and communicate with other compatible premises management devices, and a computational component configured to process system related tasks.

The memory 65, or another memory device in the premises management device 60, can store computer executable components and also be communicably connected to receive and store environmental data captured by the sensor 61. A communication interface 63 can be equipped with electrical components to transmit and receive data using a wireless protocol, such as WiFi, Thread, other wireless interfaces, Ethernet, other local network interfaces, Bluetooth®, other radio interfaces, or the like, and can facilitate transmission and receipt of data by the premises management device 60 to and from other devices.

The user interface (UI) 62 can provide information and/or receive input from a user of system 100. The UI 62 can include, for example, a speaker 67 to output an audible sound. Alternatively, or in addition, the UI 62 can include a light to be activated when an event is detected by the premises management device 60. The user interface can be minimal, such as only a small liquid crystal display (LCD), light-emitting diode (LED) display, or an LED limited-output display, or it can be a full-featured interface such as, for example, a touchscreen, touchpad, keypad, or selection wheel with a click-button mechanism to enter input.

Internal components of the premises management device 60 can communicate via the internal bus 66 or other mechanisms, as will be readily understood by one of skill in the art. One or more components can be implemented in a single physical arrangement, such as where multiple components are implemented on a single integrated circuit. Premises management devices 60 as disclosed herein can include other components, and/or may not include all of the illustrative components shown.

As previously mentioned, sensor 61 captures data about the environment in or around the device 60, and at least some of the data can be translated into information that can be used by the disclosed smart door chime system to automatically play sounds through one or more speakers in the system. Through the bus 66 and/or communication interface 63, activity data, output profiles, selected sounds and other functions can be transmitted to or accessible by other components or subsystems of the premises management system 100.

Figure 5:
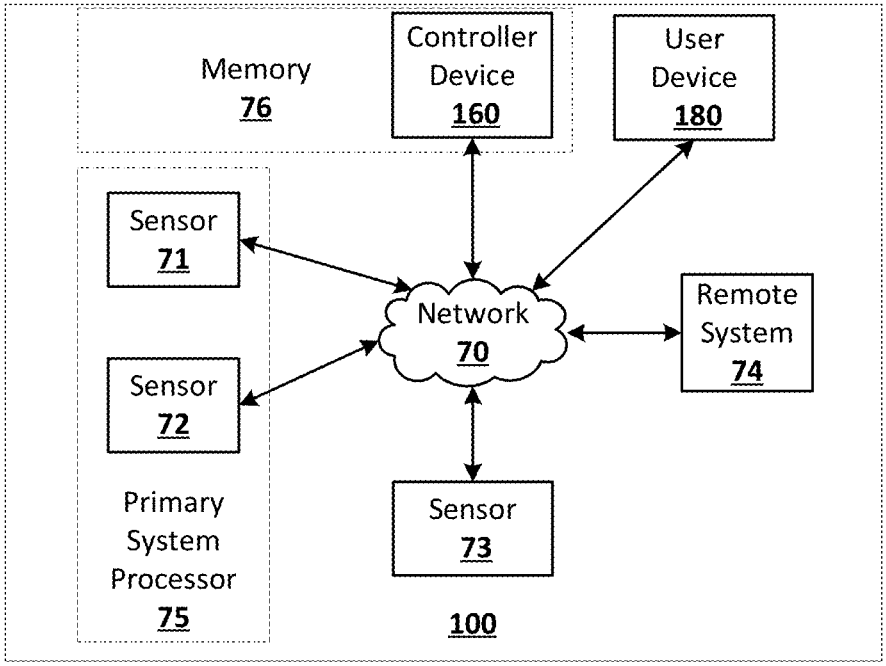
FIG. 5 shows a diagram of a system that can include a smart door chime system according to an embodiment of the disclosed subject matter.

FIG. 5 shows a diagram example of a premises management system 100 which can include an embodiment of the smart door chime system as disclosed herein. System 100 can be implemented over any suitable wired and/or wireless communication networks. One or more premises management devices, i.e., sensors 71, 72, 73, and one or more controller devices 160 (e.g., controller device 160 as shown in FIG. 1) can communicate with each other via a local network 70, such as a WiFi or other suitable network. The network 70 can include a mesh-type network such as Thread, which provides network architecture and/or protocols for devices to communicate with one another. A user can interact with the premises management system 100, for example, using a user device 180, such as a computer, laptop, tablet, mobile phone, watch, wearable technology, mobile computing device, or using the controller device 160.

In the diagram of FIG. 5 a primary system processor 75 is shown implemented in a distributed configuration over sensors 71 and 72, and a memory 76 is shown implemented in controller device 160. However, the controller device 160 and/or any one or more of the sensors 71, 72, 73, can be configured to implement the primary system processor 75 and memory 76 or any other storage component required to store data and/or applications accessible by the primary system processor 75. The primary system processor 75 can implement various functions of the disclosed smart door chime system and can receive, aggregate, analyze, and/or share information received from the sensors 71, 72, 73, and the controller device 160. Furthermore, a portion or percentage of the primary system processor 75 and/or memory 76 can be implemented in a remote system 74, such as a cloud-based reporting and/or analysis system.

The premises management system 100 shown in FIG. 5 can be a part of a smart-home environment which can include a structure, such as the premises 110 shown in FIG. 1, or, for example, an apartment, office building, garage, factory, mobile home, or the like. The system 100 can control and/or be connected to devices and systems inside or outside of the structure. Referring to FIGS. 1 and 5, one or more of the sensors 71, 72 can be located inside the structure or outside the structure at one or more distances from the structure. For example, sensors 71, 72 can be disposed at points along a land perimeter on which the structure is located, such as a fence or the like.

Sensors 71, 72, 73 can communicate with each other, with the controller device 160 and with the primary system processor 75 within a private, secure, local communication network that can be implemented wired or wirelessly, and/or through a sensor-specific network through which sensors 71, 72, 73 can communicate with one another and/or with dedicated other devices. Alternatively, as shown in FIG. 5, one or more sensors 71, 72, 73 can communicate via a common local network 70, such as a Wi-Fi, Thread or other suitable network, with each other and/or with a controller 160 and primary system processor 75. Sensors 71, 72, 73 can also be configured to communicate directly with the remote system 74.

Sensors 71, 72, 73 can be included in different types of premises management devices. Such devices can include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). These premises management devices can be used by the disclosed smart door chime system, but can also execute a separate, primary function.

For example, a smart thermostat can detect ambient climate characteristics (e.g., temperature and/or humidity) and can be used to control an HVAC system. That is, ambient client characteristics can be detected by sensors 71, 72, 73 shown in FIG. 5, and the controller 160 can control the HVAC system (not shown) of the structure based on data from the sensors. However, patterns of temperature detected by sensors 71, 72, 73 in a given area over a period of time, or sudden changes therein, can also provide data that can serve as the basis for estimating whether a room is occupied. This is a factor that the disclosed smart door chime system may utilize as will be described further below.

As another example, a smart hazard detector can detect light and the presence of a hazardous substance or a substance indicative of a hazardous substance (e.g., smoke, fire, or carbon monoxide). Light, smoke, fire, carbon monoxide, and/or other gasses can be detected by sensors 71, 72, 73 shown in FIG. 5, and the controller 160 can control an alarm system to provide a visual and/or audible alarm to the user of the smart-home environment based on data from sensor 71. However, data captured sensor 71 regarding light in a room over a period of time can also be used by the disclosed smart door chime system to detect activity. Moreover, the speaker of the hazard detector can also be used to by the disclosed smart door chime system to output customized chimes and other sounds.

As another example, one or more intelligent, multi-sensing, network-connected entry detectors (e.g., "smart entry detectors") can be specifically designed to function as part of a security subsystem. Such detectors can be or include one or more of the sensors 71, 72, 73 shown in FIG. 5. The smart entry detectors can be disposed at one or more windows, doors, and other entry points of the smart-home environment for detecting when a window, door, or other opening is opened, closed, approached, broken in, breached, compromised, or the like. The smart entry detectors can generate a signal to transmit data to the controller 160, primary system processor 75, and/or the remote system 74 when activity is detected at a window or door. The signal can provide data to the disclosed smart door chime system in order to trigger a customized chime or sound output.

Furthermore, one or more intelligent, multi-sensing, network-connected cameras (e.g., "smart cameras") can be disposed in and/or around a smart-home premises. Such cameras can be or include one or more of the sensors 71, 72, 73 shown in FIG. 5. The smart cameras can detect whether a room is occupied or vacant, identify an individual, detect movement of items, detect the presence of pets, etc. The smart cameras can generate a signal to transmit data to the controller 160, primary system processor 75, and/or the remote system 74 that indicates detected activity or lack thereof. The signal can provide data to the disclosed smart door chime system, for example, to determine whether a specific registered event has occurred or to determine where a customized chime or sound should be output, e.g., only in occupied rooms.

Smart thermostats, smart hazard detectors, smart doorbells, smart entry detectors, smart cameras, and other premise management devices of the system 100 can be communicatively connected to each other via the network 70, and to the controller 160, primary system processor 75, and/or remote system 74.

The disclosed smart door chime system can also include user specific features. Generally, users of the premises management system 100 can interact with the system 100 at varying permission and authorization levels. For example, users can set up accounts of varying class with the system 100, each class having access to different features.

Users can be identified as account holders and/or verified for communication of control commands. For example, some or all of the users (e.g., individuals who live in a home) can register an electronic device, token, and/or key fob with the premises management system 100 to enable to system 100 to identify the users and provide customized services. Such registration can be entered, for example, at a website, a system 100 interface (e.g., controller device 160), or a central server (e.g., the remote system 74) to bind the user and/or the electronic device to an account recognized by the system 100. Registered electronic devices can be recognized by the system 100, permitted to control certain features of the system 100, such as customizing events and output profiles in the disclosed smart door chime system.

Alternatively, or in addition to registering electronic devices, the premises management system 100 can make inferences about which individuals reside or work in the premises and are therefore users and which electronic devices are associated with those individuals. As such, the system 100 can "learn" who is a user (e.g., an inferred authorized user) and can customize features of the disclosed smart door chime system accordingly.

Referring to FIG. 5, the controller device 160 can be implemented using a general- or special-purpose computing device. A general-purpose computing device running one or more applications, for example, can collect and analyze data from one or more sensors 71, 72, 73 installed in the premises and thereby function as controller device 160. In this case, the controller device 160 can be implemented using a computer, mobile computing device, mobile phone, tablet computer, laptop computer, personal data assistant, wearable technology, or the like. In another example, a special-purpose computing device can be configured with a dedicated set of functions and a housing with a dedicated interface for such functions. This type of controller device 160 can be optimized for certain functions and presentations, for example, including an interface specially designed to review a data log of the disclosed smart door chime system and create customized output profiles, registered events and event assignments, as will be described further below.

The controller device 160 can function locally with respect to the sensors 71, 72, 73 with which it communicates and from which it obtains sensor data, such as in the case where it is positioned within a home that has a premises management system 100 installed therein. Alternatively or in addition, controller device 160 can be remote from the sensors 71, 72, 73, such as where the controller device 160 is implemented as a cloud-based system that communicates with multiple sensors 71, 72, 73, which can be located at multiple locations and can be local or remote with respect to one another.

Figure 6:
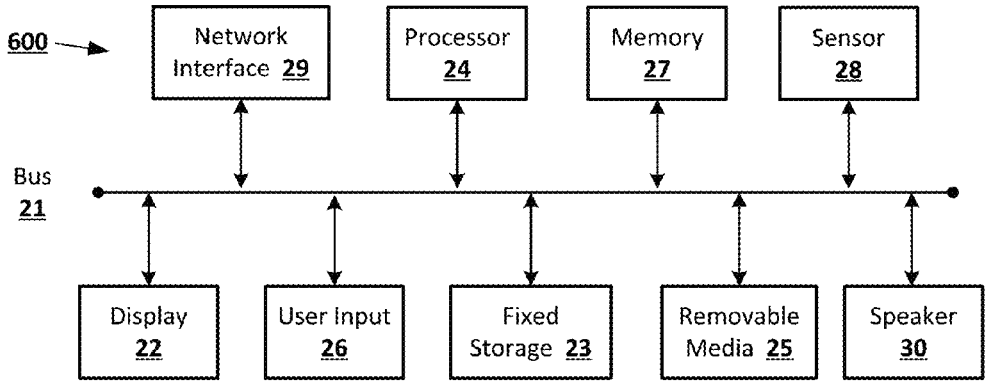
FIG. 6 shows an example computing device for implementing a controller device according to an embodiment of the disclosed subject matter.

FIG. 6 shows an example computing device 600 suitable for implementing the controller device 160. The computing device 600 can include a bus 21 that interconnects major components of the computing device 600. Such components can include a central processor 24; a memory 27, such as Random Access Memory (RAM), Read Only Memory (ROM), flash RAM, or the like; a sensor 28, which can include one or more sensors as previously discussed herein; a user display 22, such as a display screen; a user input interface 26, which can include one or more user input devices such as a keyboard, mouse, keypad, touch pad, turn-wheel, and the like; a fixed storage 23 such as a hard drive, flash storage, and the like; a removable media component 25 operable to control and receive a solid-state memory device, an optical disk, a flash drive, and the like; a network interface 29 operable to communicate with one or more remote devices via a suitable network connection; and a speaker 30 to output an audible communication to the user. In some embodiments the user input interface 26 and the user display 22 can be combined, such as in the form of a touch screen.

The bus 21 allows data communication between the central processor 24 and one or more memory components 25, 27, which can include RAM, ROM, and other memory, as previously noted. Applications resident with the computing device 600 are generally stored on and accessed via a computer readable storage medium.

The fixed storage 23 can be integral with the computing device 600 or can be separate and accessed through other interfaces. The network interface 29 can provide a direct connection to the premises management system and/or a remote server via a wired or wireless connection. The network interface 29 can provide such connection using any suitable technique and protocol, as will be readily understood by one of skill in the art, including digital cellular telephone, WiFi, Thread, Bluetooth®, near-field, and the like. For example, the network interface 29 can allow the computing device 600 to communicate with other components of the premises management system, other computers via one or more local, wide-area, or other communication networks, as described in further detail herein.

Various example features and embodiments of the disclosed smart door chime system will now be described in the context of a premises. It should be understood that the disclosed subject matter is not limited to these specific examples, rather, these examples are provided to facilitate understanding of the system.

Figure 7:
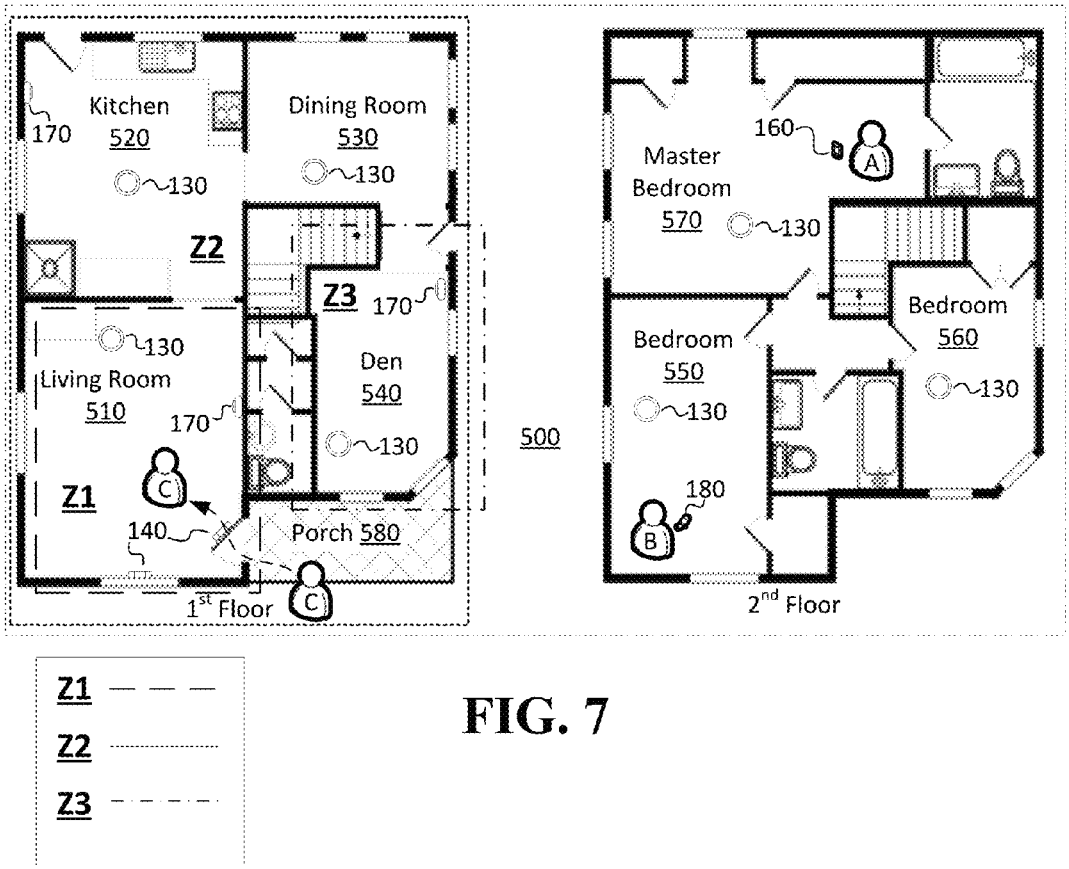
FIG. 7 shows a layout of a two-floor house including an example premises management system and smart door chime system according to an embodiment of the disclosed subject matter.

FIG. 7 shows a layout of a two-floor house 500 including an example premises management system and smart door chime system as described above installed therein. The house 500 includes a living room 510, kitchen 520, dining room 530, den 540, bedroom 550, bedroom 560, master bedroom 570, and porch 580. Authorized individuals A and B are present within the house 500. Individual A is operating a controller device 160. Individual B is carrying a mobile phone 180. Individual C is entering through the front door.

The premises management system 100 includes network-connected hazard detection units 130 installed throughout the house 500, network-connected entry detection units 140 installed at windows and doors throughout the house, a network-connected controller device 160, and network connected cameras 170. For simplicity and to avoid unnecessary clutter in the figure, only one window entry detection unit 140, one door entry detection unit 140, and two cameras 170 are illustrated. It should be understood that entry detection units 140 can be installed at multiple windows and/or doors throughout the house 500, cameras 170 can be installed in other rooms and outside of the house 500, and that other premises management devices (e.g., smart thermostats, smart doorbells, motion detectors, light detectors, etc.) as described above can be installed as part of the system 100.

The system 100 includes a memory storage that can be implemented in one or more of the devices themselves or in an external storage, such as a cloud based storage. Since the exact configuration and capabilities of the disclosed smart door chime system will depend on the number and type of sensing devices installed, upon installation the system 100 can execute a self-assessment procedure to determine a number of default chime settings. For example, a manufacturer can include a number of pre-defined events, each with threshold amounts or types of data required for detection. Pre-defined events can account for activities that range from relatively simple activities that only require data from a single detecting device, such as "window open," to more complex activities that can require compilation of data from multiple devices and/or databases. Each of the pre-defined events can be assigned a default output profile. The self-assessment procedure can determine which pre-defined events are detectable with the current configuration and activate those events in the memory as registered events that will trigger a response from the system upon occurrence and detection.

In order to coordinate information in the system, sensing devices can be assigned an identifier (ID) and/or location in the premises, for example, based on a zone map of the premises, based on a distance from a central device, based on user settings identifying specific rooms and openings, etc. In FIG. 7, three example zones are identified. A first zone Z1 includes the living room and front door, a second zone Z2 includes the entire first floor, and a third zone Z3 includes the den and side door.

When an individual approaches an opening to the premises, e.g., individual C enters the premises, one or more sensors detect activity and transmit data accordingly. For example, an entry detection unit 140 disposed at the front door can transmit data that indicates the front door has opened. A camera 170 can transmit data that indicates an individual has entered the living room 510. A Bluetooth sensor can transmit data that indicates the detected arrival of a Bluetooth device carried by individual C. In any case the system processor (e.g., controller device 160) receives the transmitted data. Based on the data, the processor determines whether a registered event occurred.

Referring to FIG. 3, in one scenario the processor receives the transmitted data and determines that registered event 310 has occurred. That is, the activity of entry into the premises by an unidentified individual has occurred at the front door. The processor then automatically executes the corresponding output profile and proceeds to play the sound "chime1.mp4" according to the "all_speakers" rule, that is, through all available speakers in the premises (e.g., through speakers provided in hazard detectors 130 as shown in FIG. 7).

As mentioned above, the disclosed smart door chime system can communicate and interact with other premises management systems. In one scenario, referring to FIGS. 3 and 7, an entry detection unit 140 in the living room 510 detects that a window has been opened and transmits data indicating this activity. The processor receives the data and determines that registered event 320 has occurred. The processor then automatically executes the corresponding output profile and proceeds to play the sound "beep1.wav" according to the "occupied_rooms" rule. In this case, the assigned sound is only played through speakers that are in rooms that are determined to be occupied, for example, based on data from smart cameras.

In another scenario, users of the smart door chime system register accounts with the system and establish an automatic identification procedure, for example, through facial recognition or gait recognition techniques through captured images, or through automatic wireless communication with registered Bluetooth enabled devices, such as a cell phone, tablet, or wearable technology, such as a watch. In this scenario, the system is in a configuration with the sensing devices required to identify registered users. Thus, when individual C enters, the smart door chime system determines that event 330 has occurred. The system then automatically proceeds to play the sound "song_clip_1.mp4" according to the "zone1" rule, that is, through all available speakers in zone Z1 (FIG. 7) in the premises.

As the above-described scenarios illustrate, the disclosed smart door chime system provides a high degree of customization per premises and per user. Depending on the available sensing devices, detected activities to be addressed can include, without limitation: an unidentified person entering the premises through a door, an unidentified person exiting the premises through a door, an identified person entering the premises through a door, an identified person exiting the premises through a door, a window in the premises being opened, a window in the premises being closed, a pet entering the premises through a door, a pet exiting the premises through a door. Each activity can have a corresponding location to constitute an event. The system therefore provides countless options that provide information as to what has occurred in or around the premises.

For example, since activity at each door and window in a home can trigger a different sound, a first set of windows, e.g. first floor windows, can trigger a first sound and a second set of windows, e.g., second floor windows, can trigger a second sound. Unidentified individuals entering at any door can trigger a specific sound while identified individuals entering at any door can trigger a different sound. A homeowner can hear different sound effects based on which door or window was opened. For example, opening a front door can cause the sound of a xylophone scale to be played, while opening a patio door could cause a sound of a referee whistle to play. Each sound could be selectable by the user so they can recall the sounds associated with each door.

In a configuration including devices that can assign identity, different sounds can be triggered based on the identity of detected individuals. For example, if the Bluetooth signature associated with a homeowner's mother's phone is detected, when she opens the front door a sound can played announcing "Grandma arrived," or her preferred sound of a violin riff.

Furthermore, the output rule of the output profile can include custom logic that minimizes disruption and increases the chance that the parties desiring to hear information from the disclosed smart door chime system can do so. For example, if it is known that a baby sleeps in a particular room, the output rule can designate all speakers except for speakers in that room as broadcasters of the output sound. Generally, and without limitation, the output rule can designate the sound be outputted through: all speakers, only in speakers in areas in the premises in which an individual is detected, or only through a pre-determined set of one or more speakers, the set being less than the full number of speakers.

The processor of the disclosed smart door chime system can further include logic to select volume settings for the sound output based on a time of day, such as a lower volume setting after a certain time in the evening or lower volume in certain areas of the premises. In a configuration in which some of the transmitted data indicates a level of ambient sound in the premises, e.g., from microphones, the processor can be further configured to select a volume setting for the sound output based on the transmitted data. For example, the volume can be higher when the ambient sound is high, as when the users are watching a loud movie, and lower when the ambient sound is low.

All of these features, including registered events, output profiles, event-to-profile assignments, and system volume settings, can be created/modified by an authorized user. The disclosed smart door chime system can receive user input, for example, through a controller device, through one of the sensing devices, through a web-based interface, or the like. The disclosed smart door chime system can also "learn" and present suggestions to the user to improve the system. For example, based on logged events the system can recommend new events to the user to register when such events occur more than a threshold number of times over a given time period, and thereby recommend new events to recognize and act upon.

In situations in which the systems discussed here collect personal information about users, or can make use of personal information, the users can be provided with an opportunity to control whether programs or features collect user information (e.g., information about a user's social network, social actions or activities, profession, a user's preferences, or a user's current location), or to control whether and/or how to receive content from the content server that can be more relevant to the user. In addition, certain data can be treated in one or more ways before it is stored or used, so that personally identifiable information is removed. For example, specific information about a user's residence can be treated so that no personally identifiable information can be determined for the user, or a user's geographic location can be generalized where location information is obtained (such as to a city, ZIP code, or state level), so that a particular location of a user cannot be determined. As another example, systems disclosed herein can allow a user to restrict the information collected by those systems to applications specific to the user, such as by disabling or limiting the extent to which such information is aggregated or used in analysis with other information from other users. Thus, the user can have control over how information is collected about the user and used by a system as disclosed herein.

The aforementioned systems/circuits/components have been described with respect to interaction between several components/blocks. A person of ordinary skill in the art would appreciate that such systems/circuits and components/blocks can include those components or specified sub-components, some of the specified components or sub-components, and/or additional components, according to various permutations and combinations of the foregoing. Sub-components can also be implemented as components communicatively coupled to other components rather than included within parent components (hierarchical). Additionally, it should be noted that one or more components can be combined into a single component providing aggregate functionality or divided into several separate sub-components, and any one or more middle layers, such as a management layer, can be provided to communicatively couple to such sub-components in order to provide integrated functionality. Any components described herein can also interact with one or more other components not specifically described herein but known by those of ordinary skill in the art.

While, for purposes of simplicity of explanation, some of the disclosed methodologies are shown and described as a series of acts within the context of various block diagrams and flowcharts, it is to be understood and appreciated that embodiments of the disclosure are not limited by the order of operations, as some operations can occur in different orders and/or concurrently with other operations from that shown and described herein. For example, those skilled in the art will understand and appreciate that a methodology can alternatively be represented as a series of interrelated states or events, such as in a state diagram. Moreover, not all illustrated operations can be required to implement a methodology in accordance with the disclosed subject matter. Additionally, it is to be further appreciated that the methodologies disclosed hereinafter and throughout this disclosure are capable of being stored on an article of manufacture to facilitate transporting and transferring such methodologies to computers. The term article of manufacture, as used herein, is intended to encompass a computer program accessible from any computer-readable device or storage media.

More generally, various embodiments of the presently disclosed subject matter can include or be embodied in the form of computer-implemented processes and apparatuses for practicing those processes. Embodiments can also be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code can configure the microprocessor to become a special-purpose device, such as by creation of specific logic circuits as specified by the instructions.

In some configurations, a set of computer-readable instructions stored on a computer-readable storage medium can be implemented by a general-purpose processor, which can transform the general-purpose processor or a device containing the general-purpose processor into a special-purpose device configured to implement or carry out the instructions. Embodiments can be implemented using hardware that can include a processor, such as a general purpose microprocessor and/or an Application Specific Integrated Circuit (ASIC) that embodies all or part of the techniques according to embodiments of the disclosed subject matter in hardware and/or firmware. The processor can be coupled to memory, such as RAM, ROM, flash memory, a hard disk or any other device capable of storing electronic information. The memory can store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as can be suited to the particular use contemplated.

The invention claimed is:

1. A system comprising:

a plurality of sensing devices disposed at a premises, the sensing devices being configured to generate data based on activity detected at one or more openings in the premises and to transmit the data;

a plurality of speakers dispersed at the premises;

a memory configured to store a plurality of sounds and two or more different output profiles that each correspond to different respective events, the output profiles comprising data that indicates a sound and an output rule that determines how the sound will be outputted; and a processor configured to identify an event based on the transmitted data and to execute a stored output profile assigned to the event, the execution including automatically playing a stored sound through one or more of the speakers in accordance with the selected output profile.

2. The system of claim 1, wherein each event comprises a detected activity and an area at the premises at which the activity was detected.

3. The system of claim 2, wherein the detected activity is one selected from the group consisting of: an unidentified person entering the premises through a door, an unidentified person exiting the premises through a door, an identified person entering the premises through a door, an identified person exiting the premises through a door, a window in the premises being opened, or a window in the premises being closed.

4. The system of claim 3, wherein the output rule determines one or more speakers among the plurality of speakers through which the sound is outputted.

5. The system of claim 4, wherein the output rule is one selected from the group consisting of: output the sound in all speakers, output the sound only in speakers in areas in the premises in which an individual is detected, or output the sound only through a pre-determined set of one or more speakers, the set being less than the full number of speakers.

6. The system of claim 4, wherein the output profiles include a first output profile corresponding to an event at a first door of the premises and a second output profile, different from the first output profile, corresponding to an event at a first window of the premises.

7. The system of claim 1, wherein the processor is further configured to select a volume setting for the sound output based on a time of day.

8. A system comprising:

a plurality of sensing devices disposed at a premises, the sensing devices being configured to generate data based on activity detected at one or more openings in the premises and to transmit the data;

a plurality of speakers dispersed at the premises;

a memory configured to store output profiles corresponding to a plurality of respective events and to store a plurality of respective sounds; and a processor configured to identify an event based on the transmitted data and to execute a stored output profile assigned to the event, the execution including automatically playing a stored sound through one or more of the speakers in accordance with the selected output profile, wherein at least some of the transmitted data indicates a level of ambient sound in the premises and the processor is further configured to select a volume setting for the sound output based on the transmitted data.

9. The system of claim 1, wherein the plurality of sensing devices include one or more cameras.

10. The system of claim 1, wherein the plurality of sensing devices include one or more Bluetooth detection devices.

11. The system of claim 1, wherein the plurality of speakers include one or more network-connected atmospheric detection devices.

12. The system of claim 1, further comprising:

an interface that receives an input from the user, wherein the input creates or modifies output profiles, or creates or modifies output profile-to-event assignments.

13. A method of providing a plurality of designated sounds based on detected activities at a premises, comprising:

detecting, with a sensing device, an activity at an opening of the premises;

generating data based on the detected activity;

transmitting the data to a processor;

identifying, with the processor, an event from among a plurality of pre-defined events based on the transmitted data;

selecting an output profile from among a plurality of different pre-stored output profiles based on the identified event, the selected output profile being assigned to the identified event and comprising data that indicates a sound and an output rule that determines how the sound will be outputted; and automatically playing a pre-stored sound from among a plurality of sounds through one or more speakers at the premises based on the selected output profile.

14. The method of claim 13, wherein each of the pre-defined events comprise, respectively, a detected activity and an area at the premises at which the activity was detected.

15. The method of claim 14, wherein the detected activity is one selected from the group consisting of: an unidentified person entering the premises through a door, an unidentified person exiting the premises through a door, an identified person entering the premises through a door, an identified person exiting the premises through a door, a window in the premises being opened, or a window in the premises being closed.

16. The method of claim 15, wherein the output rule determines one or more speakers among the plurality of speakers through which the sound is outputted.

17. The method of claim 16, wherein the output rule is one selected from the group consisting of: output the sound in all speakers, output the sound only in speakers in areas in the premises in which an individual is detected, or output the sound only through a pre-determined set of one or more speakers, the pre-determined set being less than the full number of speakers.

18. The method of claim 16, wherein the output profiles include a first output profile corresponding to an event at a first door of the premises and a second output profile, different from the first output profile, corresponding to an event at a first window of the premises.

19. The method of claim 13, wherein the processor is further configured to select a volume setting for the sound output based on a time of day.

20. A method of providing a plurality of designated sounds based on detected activities at a premises, comprising:

detecting, with a sensing device, an activity at an opening of the premises;

generating data based on the detected activity;

transmitting the data to a processor;

identifying, with the processor, an event from among a plurality of pre-defined events based on the transmitted data;

selecting an output profile from among a plurality of pre-stored output profiles based on the identified event, the selected output profile being assigned to the event; and automatically playing a pre-stored sound through one or more speakers at the premises based on the selected output profile, wherein at least some of the transmitted data indicates a level of ambient sound in the premises and the processor is further configured to select a volume setting for the sound output based on the transmitted data.

21. The method of claim 13, wherein the plurality of sensing devices include one or more cameras.

22. The method of claim 13, wherein the plurality of sensing devices include one or more Bluetooth detection devices.

23. The method of claim 13, wherein the plurality of speakers include one or more network-connected atmospheric detection devices.

24. The method of claim 13, further comprising:

receiving an input from the user, wherein the input creates or modifies output profiles, or creates or modifies output profile-to-event assignments.

* * * * *